US011680496B2

(12) United States Patent
Németh

(10) Patent No.: US 11,680,496 B2
(45) Date of Patent: Jun. 20, 2023

(54) METHOD AND APPARATUS FOR ENERGY STORAGE BASED ON DIFFERENCE IN CONCENTRATION

(71) Applicant: Wigner Fizikai Kutatóközpont, Budapest (HU)

(72) Inventor: Zoltán Németh, Budapest (HU)

(73) Assignee: WiGNER FIZIKAI KUTATÓKÖZPONT, Budapest (HU)

( * ) Notice: Subject to any disclaimer, the term of this patent is extended or adjusted under 35 U.S.C. 154(b) by 58 days.

(21) Appl. No.: 17/601,948

(22) PCT Filed: Apr. 8, 2020

(86) PCT No.: PCT/HU2020/050012
§ 371 (c)(1),
(2) Date: Oct. 7, 2021

(87) PCT Pub. No.: WO2020/208384
PCT Pub. Date: Oct. 15, 2021

(65) Prior Publication Data

US 2022/0186635 A1 Jun. 16, 2022

(30) Foreign Application Priority Data

Apr. 9, 2019 (HU) ..... P1900117

(51) Int. Cl.
*F01K 23/04* (2006.01)
*F01K 3/00* (2006.01)

(52) U.S. Cl.
CPC ..... *F01K 23/04* (2013.01); *F01K 3/002* (2013.01)

(58) Field of Classification Search
CPC . F01K 23/04; F01K 3/002; F01K 5/00; F01K 25/08; F01K 25/065; F22B 1/028; F22B 3/02; F22B 3/04; F03G 7/005
(Continued)

(56) References Cited

U.S. PATENT DOCUMENTS 3,091,518 A * 5/1963 Burke, Jr. ..... B01J 19/2415 422/135
4,055,951 A * 11/1977 Davoud ..... F01K 7/14 60/514

(Continued)

FOREIGN PATENT DOCUMENTS

FR 3016919 7/2015

OTHER PUBLICATIONS

International Search Report and Written Opinion; PCT/HU2020/050012; dated Sep. 16, 2020; entire document.

(Continued)

*Primary Examiner* — Hoang M Nguyen
(74) *Attorney, Agent, or Firm* — Allen, Dyer, Doppelt & Gilchrist, P.A.

(57) ABSTRACT

A method for extracting and storing, respectively, energy in the form of concentration gradients wherein a process of extracting energy comprising the steps of feeding stored gaseous working medium into a working volume (2), compressing the working medium in the working volume (2), spraying a dilute solution into the working volume (2) before or during compression, increasing the temperature of the working medium fed in the working volume (2) by compression, evaporating the dilute solution with the working medium of increased temperature, removing heat from the working medium by the evaporating solution, keeping the heat extracted from the working medium in the form of latent heat of the vapor in the working volume (2), further increasing the temperature of the working medium until the partial pressure of the vapor in it approaches the vapor pressure of a solution of higher concentration at a corresponding temperature, spraying a solution of higher concentration of a vapor pressure of up to 60% of the vapor pressure
(Continued)

of the dilute solution into the working medium of an expanding and high solvent vapor content, condensing the vapor in the working volume (2) onto solution droplets of the atomized solution and thereby heating the solution droplets, transferring the heat energy of the heated solution droplets to the working medium through contact surfaces of the solution and the working medium, feeding the heat previously conveyed to the dilute solution vapor during the compression back into the working medium plus as much heat as the condensation heat of the warmer vapor to the solution of higher concentration exceeds the heat of evaporation of the dilute solution, using the heat thus fed for performing work by the expansion of the working medium, obtaining the work performed by the working medium, removing the working medium and the solution from the working volume (2) after the gaseous working medium of low relative humidity is getting into a state near to its initial state, separating the working medium and the solution and returning the working medium to a container (7) for working medium and returning the slightly diluted solution of higher concentration to one of a container (11) for solution of higher concentrations and an additional intermediate container (24).

The invention also relates to an apparatus for implementing the method.

The invention can be used in all fields, where electric or mechanical energy should be stored for later use, but especially for leveling out the production and consumption differences on electrical power grids.

23 Claims, 3 Drawing Sheets

(58) Field of Classification Search
USPC ..... 60/508, 509, 512, 514, 515
See application file for complete search history.

(56) References Cited

U.S. PATENT DOCUMENTS

| | | | | |
|---|---|---|---|---|
| 4,077,214 | A * | 3/1978 | Burke, Jr. | F01K 21/02 60/512 |
| 4,617,800 | A | 10/1986 | Assaf | |
| 2009/0000288 | A1* | 1/2009 | DeVoe | F03G 7/005 60/326 |
| 2009/0225923 | A1* | 9/2009 | Neeley | G21C 1/00 376/361 |
| 2010/0183903 | A1 | 7/2010 | McGinnis et al. | |

OTHER PUBLICATIONS

Osmotic Power; Wikipedia; https://en.wikipedia.org/wiki/Osmotic_power; accessed Oct. 6, 2021; entire document.

Salinity Gradient Power: Utilizing Vapor Pressure Differences; Science; vol. 206, No. 4417; Oct. 26, 1979; abstract.

Energy Storage Technologies: Why Energy Storage; European Association for Storage of Energy; https://ease-storage.eu/energy-storage/technologies; accessed Oct. 6, 2021.

Recent Developments in Salinity Gradient Power; A.T. Jones and W. Finley; Oceans; 2003; pp. 2284-2287.

* cited by examiner

METHOD AND APPARATUS FOR ENERGY STORAGE BASED ON DIFFERENCE IN CONCENTRATION

CROSS-REFERENCE TO RELATED APPLICATIONS

This application is the § 371 National Stage Entry of International Application No. PCT/HU2020/050012, filed on Apr. 8, 2020, which claims the benefit of Hungarian Patent Application No. P1900117, filed on Apr. 9, 2019, the contents of which applications are herein incorporated by reference in their entirety.

FIELD OF THE INVENTION

The invention relates to a method according to the preamble of claim 1 for the extraction of energy existing in the form of concentration gradients and for the storage of energy in the form of concentration gradients, and on the second part an apparatus to implement the method. The invention can be used in all fields, where electric or mechanical energy should be stored for later use, but especially for leveling out the production and consumption differences on electrical power grids.

BACKGROUND OF THE INVENTION

As renewable energy resources gain ground mass energy storage become more and more important, since electric energy production and consumption peaks appear at different times. Thus at the time of peak consumption there is an energy deficiency, while at the time of production peak there is a surplus of energy, which is present managed by peaking power plants, which can be started and stopped rapidly (e.g. gas turbines), but the operation of such peaking plants is expensive. In the absence of a sufficient energy storage solution, the proportion of peaking power plants should be increased together with the proportion of renewable sources, which is expensive, environment polluting, and difficult to achieve. This problem is currently the biggest obstacle in the path of renewable energy.

Realizing the demand several solutions were devised for mass energy storage, but these cannot spread due to various shortcomings: either their energy density is too low or their life cycles cost is too high.

A summary of known technologies used or developed for mass energy storage can be found at the link below:

http://ease-storage.eu/energy-storage/technologies/.

A copy of the above page can also be found at the following address of the Internet Archive Wayback Machine Service: https://web.archive.org/web/20180817024958/http://ease-storage.eu/energy-storage/technologies.

The most widespread method for mass energy storage is the "pumped water" or "pumped hydro storage" (PHS), in which during periods of low demand and high availability of electrical energy, the water is pumped and stored in an upper reservoir. One drawback of this technology is that its energy density is very low, about 0.1 kJ/kg. Due to the low energy density the initial investment required is enormous and often negative environmental effects have to be taken into account around the site installation.

An example to the other extreme is batter storage, e.g., the solution named Powerwall by the company Tesla from USA has an energy density of 230 kJ/kg and a price around 0.13 USD/kJ (450 USD/kWh). Rechargeable batteries are excellent for storing low amounts of energy and in mobile devices, but their application for mass energy storage is limited by their price and relatively low lifetime. A further problem of battery storage is that they use materials, which are difficult to come at an/or cause pollution.

SUMMARY OF THE INVENTION

The purpose of this invention is to allow the storage of large amounts of energy cheaply, in relatively compact dimensions in an environment friendly way. We aim at an energy density close to the battery storage, but with longer lifetime; investment cost significantly lower than a peaking power plant of similar capacity, its maintenance (with no pollution whatsoever) should be much cheaper than that of a peaking power plant.

The state of the art knows several methods for energy extraction from concentration gradients, but these did not find widespread use due to various reasons. These solutions are virtually never used for energy storage, probably because the storage application has even higher requirements. Below we briefly describe the principle of energy extraction from concentration gradients, and the problems of the existing solutions, which make them insufficient to reach the aim of the invention.

Concentration gradients are the basis of devices utilizing osmotic pressure, see e.g. the paper and references available at https://en.wikipedia.org/wiki/Osmotic_power. These devices generally use special membranes, the low permeability, short lifetime and/or high price of which restrict their widespread use. An excellent overview of the topic can be found in the work of Jones and Finley, "OCEANS 2003. Proceedings, DOI: 10.1109/OCEANS.2003.178265", which can be accessed at the internet address http://waderlic.com/2284-2287.pdf for example.

The use of semipermeable membranes can be avoided if the solutions of different concentration are only connected through their vapor phases. It is well known that the vapor pressure of a solution varies as a function of the amount of the solute, the vapor pressure over salt solutions is usually much lower than that over the pure solvent. If two container having the same pressure, one comprising pure solvent and its vapor, the other comprising a solution and its vapor—mainly the vapor of the solvent—are connected through their vapor space, then their vapor pressures equalize and the liquid in the container of pure solvent starts evaporating (boiling) intensely. This process keeps going as long as the pure solvent cools down to a temperature, on which its vapor pressure is equal to that of the solution. The vapor condensates in the other container and dilutes the solution. The process in this form stops quickly due to the growing temperature difference. If, however there is a connection of good thermal conductivity between the two containers through e.g. the wall of a heat exchanger, then the latent heat released by the condensation in one of the containers continuously heats the liquid evaporating in the other container, thus that liquid keeps boiling as long as there is a concentration difference between the two containers. The same principle is behind the vapor compression desalination see B. W. Tleimat: "Paper presented at the American Society of Mechanical Engineers Winter Annual Meeting, Los Angeles, 16-20 Nov. 1969, furthermore Mark Olsson et al. have presented an energy extraction possibility utilizing vapor pressure differences see: Olsson et al.: "Salinity Gradient Power: Utilizing Vapor Pressure Differences, SCIENCE, VOL. 206, 26 Oct. 1979", the paper can also be seen at the internet address http://www.sciencemag.org/cgi/content/abstract/206/4417/452. The result were never utilized in industrial scales, because the vapor pressure of aqueous solutions appearing naturally or as industrial wastes differs so minutely from the vapor pressure of water, that the necessary turbine sizes are unattainable. The prototype created by Olsson and his colleagues had an efficiency of 23%, which is acceptable for energy generation, but energy storage is not practical at such low efficiencies and thus were never even been suggested.

A huge advantage of the idea suggested by Olsson et al. is that it does not require special membranes; it uses reliable, long-lived components. It has however three significant problems: due to the very low pressure differences it would require huge turbine diameters in the order of 100, due to the small temperature differences the surface of the heat exchangers should be unpractically large, and the devices realized until now has efficiencies which are too low to be used for energy storage.

The present invention is based on the recognition that if in a thermodynamic cycle the heat extraction is performed by evaporating a dilute solution or pure solvent, then the extracted heat can be recovered at a higher temperature by getting the humid working medium in touch with a solution of higher concentration, for which the vapor pressure of the solvent at the same temperature is lower. Thus the vapor condensates on the higher concentration solution and the heat extracted during the evaporation of the solvent is returned into the cycle as condensation heat. Thus the working medium recovers the energy, which it conveyed to the vapor previously plus as much as the condensation heat here is larger than the vaporization heat of the heat extraction process. In such a cycle the energy stored as concentration differences can be extracted with high efficiency, the efficiency has no thermodynamic limit. Driving the cycle in the reverse direction the mechanical work fed into the process can be stored with high efficiency in the concentration difference of the solutions.

Another recognition of the invention is that if instead of the vapor of the solvent another material, suitably an inert gas, is used as working medium, then a much quicker heat exchange and, with respect to the afore mentioned Olsson method, two or three orders of magnitude higher pressure can be attained. Thus the specific power of the energy conversion device can be much higher, while the size of the heat exchanger can be much lower. The pressure can be increased by increasing the amount and the temperature of the working medium, while the problem of the heat exchanger is solved by the dedicated working medium by performing the heat exchange between the solutions and the working medium, instead between the two solutions. Thus, it is not necessary to use a closed heat exchanger anymore, which can separate the solutions chemically as in the Olsson method, we can use one or more open heat exchanger(s) for the rapid heat exchange between solution and working medium. For example one solution is injected into the working medium in the as a spray or mist, where it is in touch with the working medium through the huge total surface of the multitude of minute droplets. The heat exchange between the working medium and the other solution is performed in a similar manner, but spatially or temporally separated from the heat exchange with the first solution, which ensures that the solute cannot get into the container comprising the dilute solution—which for our purpose can also be pure solvent, for example pure water, but it can contain solutes in smaller quantities, just like tap water and seawater. The higher pressure and quicker heat exchange significantly improve the efficiency as well, since in this process the efficiency is limited by the losses occurring due to mechanical and viscous drag and in the heat exchanger, instead of a principal thermodynamic limit. The second is minimalized by the much more efficient heat exchange, since as the heat exchange is performed through a much larger surface in the open heat exchanger, almost all of the heat can be recovered, the heat loss occurring due to the condensation at the walls of the device is negligible for larger machines.

Another recognition of the invention is that a large part of the frictional and mechanical loss can be recovered if the energy conversion devices are cooled by the solutions themselves, which this way convey the recovered heat to the working medium.

The method and apparatus according to the invention is presented below in more details with the aid of advantageous examples, with reference to the attached drawing, where:

DETAILED DESCRIPTION OF PREFERRED EMBODIMENTS

Figure 4:
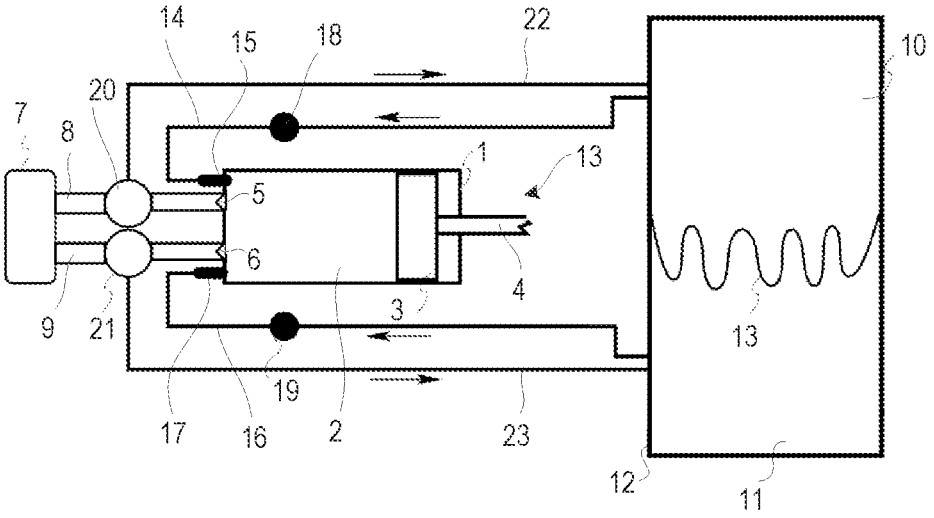
FIG. 4 shows a block diagram of an advantageous embodiment of the apparatus according to the invention.
Figure 5:
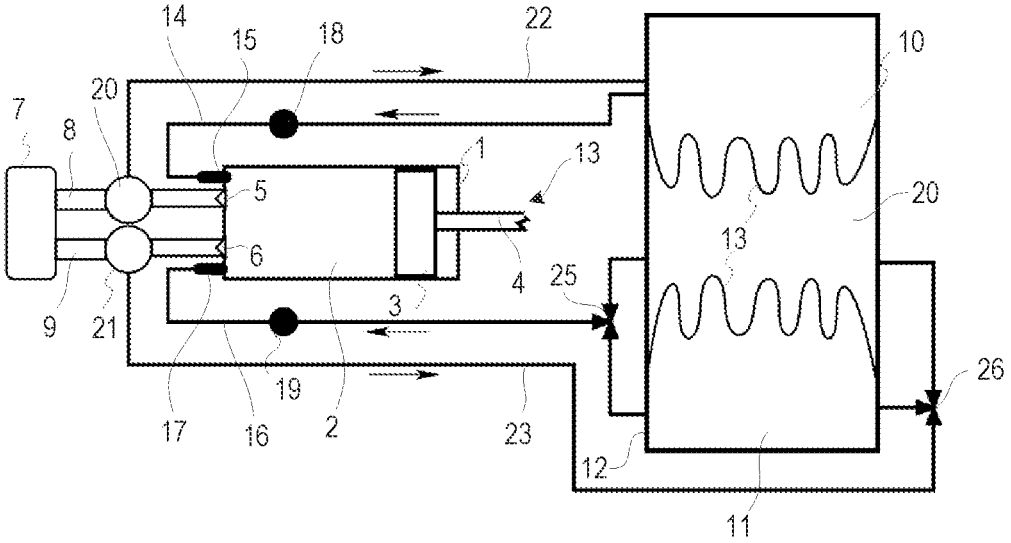
FIG. 5 shows a block diagram of a further advantageous embodiment of the apparatus according to the invention.

Two possible realizations of the apparatus according to the invention are outlined in FIGS. 4 and 5 where both embodiments utilize piston heat engines of know structure and operation. The heat engine comprises a cylinder 1, which comprises a working volume 2. In the working volume 2 there is a movable piston 3, a piston rod 4 of which is connected via a drive train with an electric appliance in a way well-known to a person skilled in the art. In case of transforming electric energy to mechanical energy the electric appliance is an engine, in case of transforming mechanical motion into electric energy it is a generator, both function can be served by an electric appliance, which can function both as engine and generator. In the cylinder 1 there are valves 5, 6 connected to the working volume 2, through these valves 5, 6 and ducts 8, 9 the working volume 2 is connected with a container 7 for working medium. In the present embodiment the apparatus according to the invention comprises separate containers 10, 11, where the container 10 comprises the dilute solution and the container 11 is for the higher concentration solution. Since the sum of the volume of the two solutions is nearly constant—for salt solutions the variation is only a few tenth of a percent—in the advantageous embodiment depicted in FIG. 1 the containers 10 and 11 of the two solutions are situated in a single tank 12. The container 10 for the dilute solution is separated from the container 11 for the higher concentration solution by a flexible wall 13 in an impermeable way; with this the volume requirement of the storage of the solutions can be significantly reduced compared to an arrangement utilizing two separate tanks. The container 10 for the dilute solution is joined to an injector 15 built into the cylinder 1 through a duct 14, while the container 11 for the higher concentration solution is joined is joined through a duct 16 to an injector 17 built into the cylinder 1. For the purpose of fluid displacement a pump 18 is built into the duct 14 and a pump 19 is built into the duct 16. A droplet separator 20 is installed into the duct 8 and a droplet separator 21 is installed into the duct 9. The fluid output of the droplet separator 20 is connected to the container 10 of dilute solution through a duct 22, the fluid output of the droplet separator 21 is connected to the container 11 for the higher concentration solution through a duct 23.

Figure 2:
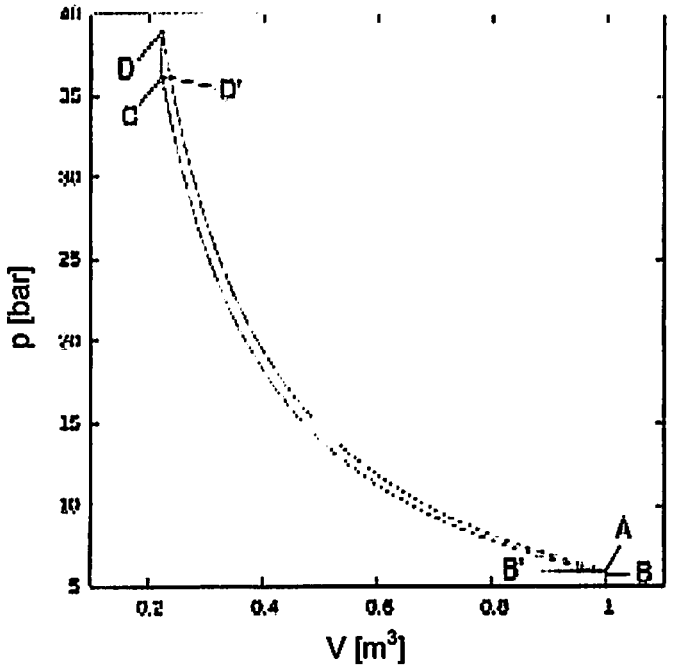
FIG. 2 is the pressure-volume diagram of the method described in FIG. 1
Figure 3:
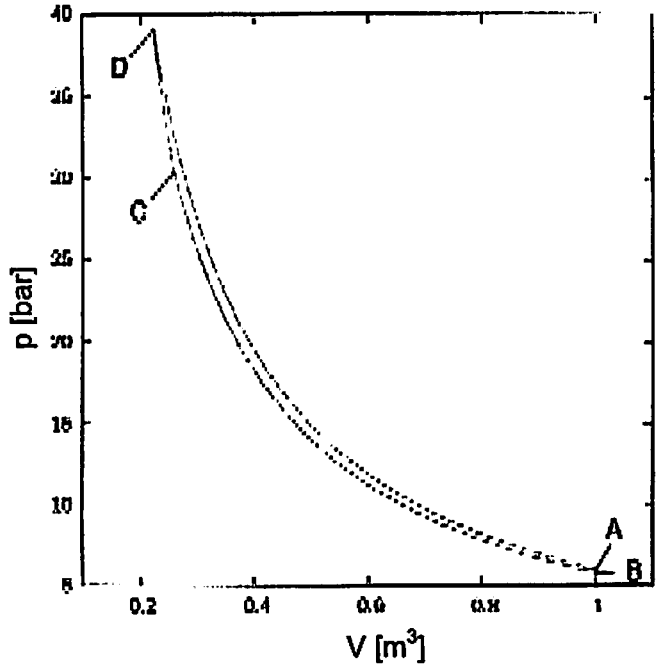
FIG. 3 shows a pressure-volume diagram for a further advantageous implementation of the method according to the invention.

The method according to the invention is described in more details below through an advantageous implementation using FIGS. 1-3, while example embodiments of the apparatus materializing the method are described using FIGS. 3 and 4. The scope of the invention is not limited to these examples, the numerical values, such as the work volume minimum and maximum temperatures, pressure and humidity values can be varied in a broad range.

Figure 1:
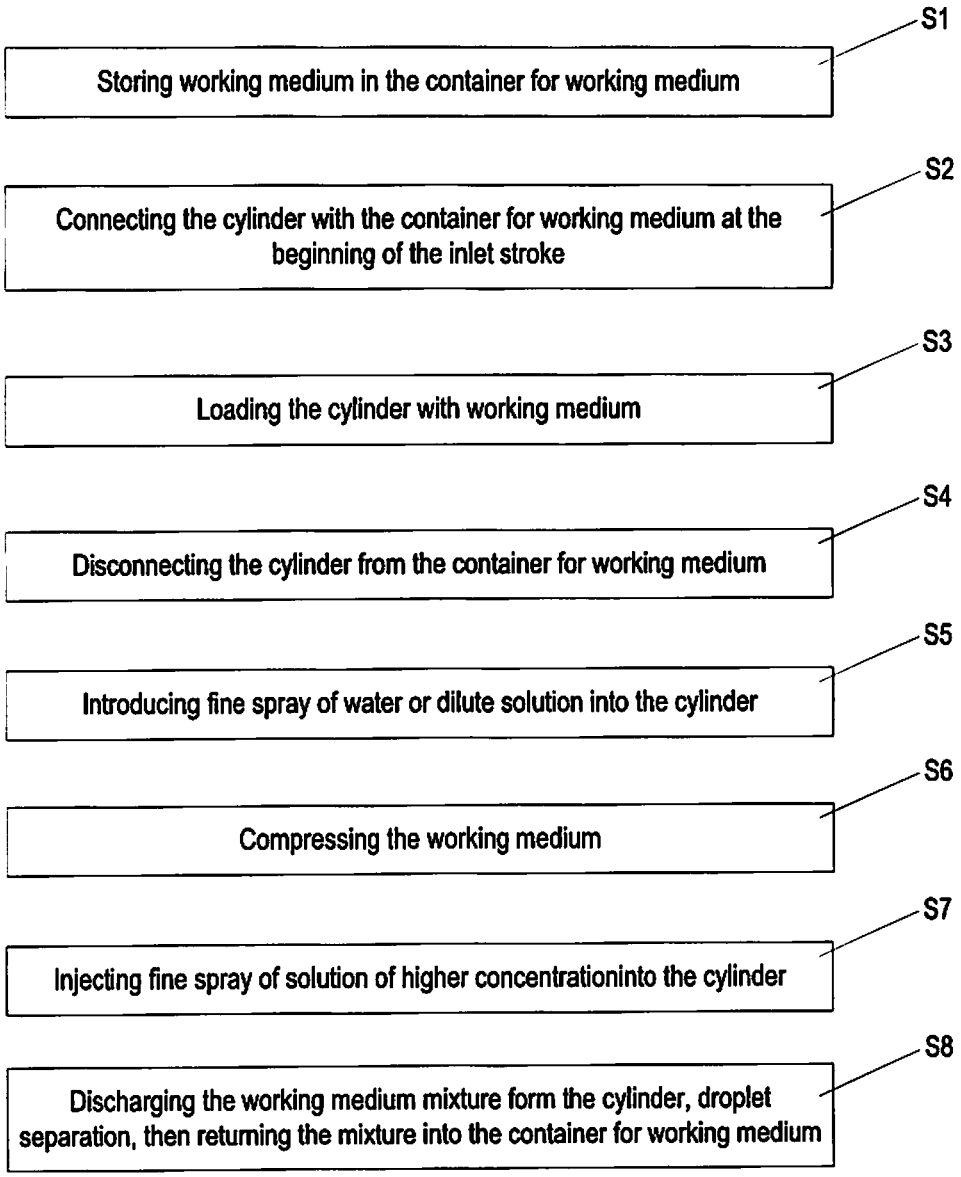
FIG. 1 is the flow chart of an advantageous implementation of the method according to the invention.

In the example implementation of the method shown in FIG. 1, in step S1 inert gas, for example Argon at 6 bar pressure and near room temperature that is at 300 K or 27° C., as working medium is stored in the container 11 for working medium. We use a piston engine as a heat engine having a cylinder 1 of a volume 1 $m^3$, the compression ratio of the engine is 1:4.48. It is important to note that the method can be realized by reciprocating devices comprising pistons and cylinders and by turbomachinery alike, or rather every known principle for fluid displacement can be utilized, for the sake of simplicity in the present examples we speak about reciprocating engines having a working volume 2, this term covers either cases.

In step S2 in the beginning of an intake stroke when the piston 3 of the engine is at the inside dead center the cylinder 1 is joined with the container 7 for working medium. In step S3 the piston is moved outside from the inside dead center, and thus the cylinder is loaded with working medium. At the end of this step the state of the working medium inside the cylinder is: volume 1 $m^3$ pressure 6 bar temperature 300 K. This state is marked by point A in the pressure-volume diagram of FIG. 2. The working medium comprises 0.4 mol water vapor. In step S4 in the beginning of the next—compression—stroke the cylinder 1 is closed, preferably with a valve 5 it is separated from the container 7 for working medium. In step S5 fine spray of water or dilute solution is introduced into the cylinder, due to its large total surface is evaporates rapidly and cools the working medium until the humidity in the cylinder 1 nears 100%. At that time the temperature of the gas mixture is 292 K, its water content is 1 mol, its pressure is 5.85 bar, this state is marked as point B in the pressure-volume diagram of FIG. 2. We note that the temperature of point B can be varied between 274-330 K without a significant deterioration of the efficiency, during this variation the highest pressure of the cycle varies about 5%, the highest pressure varies 15%. Above this region the vapor content of the working medium increases significantly and the heat loss towards the environment also increases. In step S6 we compress and thus heat the working medium by moving the piston inward towards the inside dead center. The droplets of the fine spray continue evaporating in the warming working medium, thus slowing down the temperature increase. The variation of the state of the working medium during the compression stroke is represented by the line segment between points B and C in the pressure-volume diagram of FIG. 2. The amount of the injected water or dilute solution—naturally occurring water always comprises some solutes and thus, strictly speaking, the tap water, the water of rivers and seas, etc. are dilute aqueous solutions—is chosen e.g. by experiment, simulation or calculations known to the experts in such a way that whereon the piston reaches the inside dead center the droplets have evaporated. In point C of the pressure-volume diagram of FIG. 2 the volume of the working medium is 0.223 $m^3$, its pressure is 36.2 bar, its temperature is 404 K (131° C.), its water vapor content is 18 mol. Then in step S7, fine spray of higher concentration solution is introduce into the cylinder 1, some of the vapor condensates onto the droplets and thus heats them, and the warm droplets heat the working medium. The state changes into state marked as point D of the pressure-volume diagram of FIG. 2, the pressure is 38.95 bar, the temperature 434 K (161° C.), the water vapor content is 15.5 mol. This step is rather counter intuitive as one would expect a pressure drop due to vapor condensation. Although the partial pressure of water really decreases, the pressure of the inert gas heated by the condensation heat rises much more, and the net effect is a pressure increase. The working medium expands pushing the piston outwards, the state change during the expansion stroke is represented by the line segment between points D and A in the pressure-volume diagram of FIG. 2. As the working medium cools more and more vapor condenses onto the droplets, thus slowing down the temperature decrease. At the outer dead center the state of the working medium returns to the state marked by point A in the pressure-volume diagram of FIG. 2. In step S8 the working medium is pushed out of the cylinder 1 by the piston 3 through the valve 5, and after droplet separation, it is returned to the container 7 for working medium. To get a more clear-cut figure, the intake and exhaust strokes are not shown in the pressure-volume diagram.

With the cycle described above we get about 55 kJ work, which means that an energy conversion machine comprising four such cylinder 1*s* and operated at 1500 revolutions/minute, namely a 13 engine yields 5.5 Mw power.

The pressure in the container 7 for working medium is proportional to the amount of gas flowing through the engine, and thus it has to be increased as much as possible. The pressure of the container 7 for working medium is limited by the compression ratio and the maximum allowable pressure—this is point D in the pressure-volume diagram of FIG. 2—inside the energy conversion machine. In the above examples the pressure of the container 7 for working medium varies between 0.5-16 bar. The pressure in the container 7 for working medium is constant in every example, but the constant is different in the different examples.

In the examples below, we allow about 40 bar maximum pressure inside the working volume 2 this value divided by the pressure ratio gives the pressure in the container 7 for working medium. If the walls of the working volume 2 can withstand 80 bar for example, the above values can of course be doubled.

A cycle analogous to the above described cycle can of course be realized in turbines as well, or—using both sides of the piston 3 as a working volume—as a two stroke engine. In a realistic cycle the corners marked with letters in the diagram are rounded.

As long as there are droplets of the dilute solution in the working volume 2, the state of the working medium varies along a curve uniquely determined by one of its points and the requirement that the partial pressure of the vapor inside the working volume 2 should be equal to the vapor pressure of the dilute solution. In what follows we will call that segment of the cycle, which lies on this curve the lower branch of the cycle. It was the line segment between points B and C above.

As long as there are droplets of the higher concentration solution in the working volume 2, the state of the working medium varies along a curve uniquely determined by one of tis points and the requirement that the partial pressure of the vapor inside the working volume 2 should be equal to the vapor pressure of the higher concentration solution. In what follows we will call that segment of the cycle, which lies on this curve the upper branch of the cycle. It was the line segment between points D and A above.

Although the above examples the A-B and C-D segments passing between the lower and upper branches correspond to isochoric (constant volume) processes, this is not necessary. In implementations using turbines, these segments could be isobaric (constant or nearly constant pressure) processes, namely, instead of vertical, horizontal line segments, such segments are shown as dotted lines between points A-B' and C-D' in FIG. 2 for the present example. In this case, when the evaporation of the water droplets injected into the flow of the working medium starts to cool the working medium, instead of its pressure, its volume will decrease as long as the vapor became saturated, and the state of the system gets onto the lower branch at point B'. In case of turbomachinery the heating effect of the higher concentration solution injected after the compressor also manifests as an isobaric process. The volume increases as long as the state gets onto the upper branch at point D'. Other different variants of the segments passing between the lower and upper branches can also be implemented for example by varying the temporal characteristic of the injection or the intake geometry.

The compression ration can also be varied in a wide range. Apart from the value in the above example we also preformed simulations with a value of 1:1.82, which corresponds to a 2.4 pressure ratio. This very low value can be interesting because it can be achieved even with single stage centrifugal turbines. The efficiency is good here as well, but the work yield for a given mass flow in this region is proportional to the volume change, and thus—for the same initial pressure—it is lower here than in the example presented above. Using construction materials of similar strength though, for this lower compression ratio we can increase the pressure of the container 7 for working medium, in this example to 16 bar preferably this also increases the mass flow, and thus we can reach similar yields with simpler compressors. Apart from the value in the above example we also performed simulations with a compression ratio value of 1:33, this also proved to be operable, here the pressure in the container 7 for working medium is only 0.5 bar, and the pressure ratio is 70, which is impractical, and the power yield for a given mass flow is also smaller.

Modifying the example, described above we can implement a significantly different segments passing between the lower and upper branches by using the adiabatic process in part of the compression: If we inject less dilute solution into the working volume in the compression stroke of step S4 than the maximum, which can be evaporated during the stroke, then the droplets will already be evaporated at partial compression. After that the further compression will cause an adiabatic process, which means a much faster heating than the compression accompanied with evaporation. The p-V diagram of such a cycle can be seen in FIG. 3. The segment between A and B, most of the compression segment and the segment between B and C is the same as those described earlier, with the exception that in step S5 instead of 17.6 mol only 15.3 mol water is injected into the working volume. The droplets are used up at point C of the curve at volume 0.26 $m^3$, pressure 30.4 bar and temperature 121° C., the state will get onto the upper branch of the cycle along the adiabatic compression process between points C and D. After point D the cycle continues according to the earlier descriptions. Thus the condensation heating segment between points C and D of FIG. 2 is replaced by the adiabatic compression between points C and D in FIG. 3.

In a preferred embodiment the energy conversion and heat exchanger function is combined in one place in a cylinder 1. In step S2 at the first stroke of operation moving the piston 3 we charge the cylinder 1 with working medium, preferably inert gas devoid of oxygen, for example Nitrogen or Argon. By using an inert gas, we can significantly lower the corrosion of the components. The intake stroke is followed by the closing of the intake of the cylinder 1 in step S3, and in step S4 the compression stroke. Either during the intake stroke, in the intake duct or inside the cylinder 1, or during part of the compression stroke in step S5 we spray pure water into the working medium. It is well-known to the experts that spraying is a suitable way to produce an interface of large total surface between liquid and gas, it is generally used for accelerating the vaporization of fuels. In case of injection during the intake stroke, it could be enough to spray bigger droplets, because the droplets spend a longer time inside, there is a larger likelihood that the droplets stick onto the walls; injecting during the compression stroke requires finer spray, but it can be controlled better, its realization is more difficult and more expensive. The small droplets evaporate during the compression stroke and extract heat from the working medium. The main part of the heat extracted from the working medium is turned into the latent heat of evaporation of water, and in this form it remains inside the cylinder 1, which can be thermally insulated. At the end phase of compression, when the evaporation is virtually done, we farther compress the gas in a nearly adiabatic way. During the following work stroke, the working medium expands and pushes the piston 3, in step S7 a higher concentration solution having a low vapor pressure is injected into this humid expanding gas, for example calcium chloride solution of 40-60 mass % or saturated magnesium chloride solution. The higher concentration solution is continuously diluted during energy extraction, its concentration is 60% in the wholly charged system, while near depletion it is 40%. The vapor present in the cylinder 1 condensates on the droplets of the saline solution and heats them. The droplets transfer this heat through their huge total surface to the cooling working medium. During this process the working medium recovers the energy it has transferred to the vapor during the compression stroke, plus the difference between the condensation heat of the warmer vapor to the saline solution and the evaporation heat of pure water. For the calcium chloride solution according to the example this is approximately 10%. This excess energy is the energy stored in the system as salinity difference, and what is converted into work. At the end of the work stroke the dry gas expands further, after which it returns to approximately the starting state. In step S8 in case of a piston engine by opening its exhaust, in case of a turbomachinery in a way usual to that the gas and saline solution is removed from the working volume, the liquid and gaseous components are separated by a known droplet separation method, the working medium gas is returned into the container 7 for working medium, the somewhat diluted solution is returned into the container 11 of the higher concentration solution, and the cycle can start over.

It can be seen that the thermodynamic efficiency of the cycle with respect to the working medium is only 10%, but the 90% is stored as evaporation heat during heat extraction and can be almost completely recovered during heat input as condensation heat. Loss can result from the effect that the tiny droplets of the atomized solution remain warmer than the working medium returned into the starting state. The magnitude of this effect depends on the size of the droplets, the mass ratio of gas and liquid, the flow conditions, but the heat lost this way is negligible compared to the total condensation heat. Similarly, in case of a large, thermally insulated cylinder 1, the number of the droplets touching and transferring heat to the wall is small and thus the heat lost there is also negligible and the energy stored in the concentration difference is almost entirely turned into work with very high efficiency.

The reverse cycle can obviously be used for storing energy, with the exception that at the high end of the compression stroke—which is now performed at higher temperature and the solvent is evaporated from the higher concentration solution—the humid gas has to be driven through a 20, droplet separator 21, before it can participate in the expansion stroke. At the end of the expansion stroke—which is now cooler, and the vapor is condensed onto the droplets of the dilute solution—the droplets are also separated by the gas preferably with droplet separators 20, 21. In this way most of the invested work is stored in the increasing concentration difference of the solutions. The energy, which can be stored using the solutions in the examples, is close to the 80-130 kJ/kg energy density of lead-acid batteries, but the storage capacity can be increased without limits by adding mora water and salt. The method is environment friendly, it uses only simple well-known and durable elements and its energy density is several magnitudes higher than that of the most widespread pumped hydro plants.

In another preferred embodiment the heat exchange and work production is spatially separated. In this version the compressed humid working medium is at first loaded into the working volume 2, where higher concentration solution is sprayed into it, to heat the working medium by the warming droplets heated by the condensation heat of the vapor. The resulting higher temperature working medium extends into a turbine after droplet separation or gas-engine, where it produces work, after exiting the turbine or engine pure water is sprayed into the now colder and dry working medium to extract heat. During this phase the density and vapor content of the working medium increases. After further compression the humid working medium is returned to the beginning of the cycle.

The energy stored in the latent heat of vapor can be lost if the vapor condenses on the walls of the machine, for example on the walls of the cylinder 1, and the walls conduct and transfer that heat into the environment. To minimize this effect, in a preferred embodiment of the apparatus according to the invention those part of the apparatus, which can get in touch with the vapor are thermally insulated from the environment. This can be accomplished by using ceramic cylinder walls or by thermal insulation surrounding the cylinder 1, which, depending on the temperature, can be glass wool, rock wool, but since the temperature is low, it can even be a thermal insulation made of plastic materials.

In this way the walls equilibrate at a higher operational temperature, which on one hand reduces the condensation on the walls to a minimum, and on the other hand heats the working medium in its cold state. With a perfect insulation the equilibrium would form at the average temperature of the thermodynamic cycle, which in the above example is 85° C. The temperature of the wall of course can vary significantly along the axis of the cylinder, at the inner parts it is warmer, but the principal goal of the thermal insulation is the reduction of heat loss.

In further preferred embodiment the dilute solution can be used for other purposes as well, it can even be a natural open body of water, for example the water of a pool, lake, river, quarry pond, oxbow lake or sea, under the surface of which one or more flexible sack-like container or balloon encloses the higher concentration solution. This version is highly scalable, the storage capacity can be easily increased by adding new balloons (which can be of standardized size).

In further preferred embodiment the higher concentration solution is saturated at the storage temperature, and it comprises some undissolved solute material. For example water can dissolve 35.2% magnesium chloride at 20° C., while at 100° C. it can dissolve 42%, any excess over this remains undissolved. As during normal operation we introduce solvent into the solution some of the excess salt dissolves to keep the concentration at the saturation level corresponding to that temperature. This means that the concentration of the solution remains constant within certain limits, while during the operation of the apparatus solvent is introduced into or removed from the solution. In the fully charged (by energy) state of the energy storage apparatus a significant portion of the solute material can be in an undissolved state.

In choosing the storage temperature we take into account that the saturation concentration increases with the temperature, thus the amount of dissolved salt and also vapor pressure, both effects improve the energy density. On the other hand the heat loss through the walls of the containers also increases, although this loss is insignificant for large, thermally insulated containers. To store the solutions under the temperature of the environment is impractical, while the upper temperature limit is given by the rationale that building the whole container pressure-tight would be also impractical, which means a practical limit of 100° C. or 90° C. for safety.

In the preferred embodiment shown in FIG. 5 the tank 12 encloses three separate containers 10, 11, 24 for the dilute, higher and medium concentration solutions. The duct 16 joins to the outlet of a three-port valve 25, one inlet of the three-port valve 25 is connected with the container 11, while its other inlet is connected with the container 24 in a way, which allows fluid transfer. Another port of the container 11 is connected with one outlet of another three-port valve 26, the inlet of the three-port valve 26 is connected to the duct 23, its other outlet is connected with the container 24 in a way, which allows fluid transfer.

During energy extraction the higher concentration solution is sent into the heat engine, where it is diluted to medium concentration, as in the process described earlier. In this case we use the three-port valve 25 to connect the duct 16 to the container 11. The produced medium concentration solution is not returned into the container 11 but into the container 24 established for this purpose. To this end we use the three-port valve 26 to connect the duct 23 to the container 24. The advantage of this configuration is that this way we can use a solution of constant concentration for heat input during the whole energy extraction phase. During energy storage we use up the solution from the container 24 for medium concentration solution, the water is evaporated from the medium concentration solution during the energy storage process, and the resulting higher concentration solution is accumulated in the container 11 of higher concentration solution. For this purpose the three-port valves 25 and 26 are set to connect the duct 16 to the container 24 and the duct 23 to the container 11. The three containers 10, 11, 24 can be established inside a single tank 12 separated by flexible walls 13.

In further preferred embodiment at least on of the solutions are heated in a dedicated closed heat exchanger before it enters the energy conversion unit. The upper limit of the solution temperatures was set by the heat loss and pressure tightness of the containers, but it is not necessary to increase the temperature of the 10, 11, 24 containers, it is enough to heat the liquid currently in use, which required the above mentioned dedicated closed heat exchanger. The lower limit of the temperature is the temperature of the environment, the upper limit is the critical point of water, 374° C. For practical purposes it is expedient to choose a temperature between 50-150° C. The highest temperature occurring in the thermodynamic cycle should be kept below the critical point of water 647 K, practically significantly lower for example below 520 K that is below about 250° C.

After use the solutions are cooled back storage temperature. If the solution in question is the higher concentration solution, and the apparatus is used in energy extraction mode, than we can add more solute material to the heated solution just before its use, since at higher temperature the saturation concentration is higher.

By raising the temperature of the tank 12 or possibly one or more of the 10, 11 or 24 containers we can accomplish several different goals, on the one hand we can dissolve more solute materials in the higher concentration solution, which improves the energy storage capacity, on the other hand we can approximate the temperature of the solutions to the operation temperature of the heat engine. In the case of suitably large 10, 11, 24 containers the heat loss through the walls is small compared to the amount of the stored energy even with feasible thermal insulation; in a further preferred embodiment the heat lost this way is replenished by the mechanical losses of the heat engine.

According to a further advantageous implementation method the location of energy storage and extraction can be spatially separated. This way the solutions of different concentration can be used as fuels to provide energy for mobile devices. Refueling can be performed by quickly loading fresh solutions and venting the spent medium concentration solution. Changing the solutions can be performed in a few minutes at the fueling station, later the fueling station restore the concentration difference using some energy. Since the energy density of energy storage based on concentration differences is lower than conventional fuels, this implementation can be used, where the increased mass compared to conventional fuels is not a problem.

It is advantageous to configure the system in such a way that during operation the pressure of the gas in the container 7 for working medium does not change significantly. One way to accomplish this is choosing the volume of the container 7 for working medium to be significantly larger than that of the cylinder 1. It is more practical however to configure the heat engine in such a way that the difference of the amount of gas drawn from the container 7 for working medium and the amount vented into it at the same time is always close to zero. In case of a four-stroke configuration the intake stroke of a cylinder 1 always coincide with the exhaust stroke of another cylinder 1 if the number of cylinders is four or its integer multiple, which means that the same amount taken in by one cylinder 1 is at the same time exhausted by the other. In case of a turbomachinery the intake and exhaust of the machine are also equal. This way the size of the container 7 for working medium can be minimized.

The low maximum temperature of the thermodynamic cycle (typically 100-200° C.) makes it possible to use light metals, composites or even plastics as construction material, insulator and coating. The low pressure ratio allows the use of simple few stage compressors and turbines.

The thermodynamic cycle operated in reverse stores the work fed into it in the growth of concentration difference of the solutions. Such a process can be presented using FIG. 2, although now the ground state corresponding to the gas state in the container 7 for working medium is marked by point B. We introduce higher concentration solution into the working medium drawn into the cylinder 1, the working medium has 0.4 mol/m$^3$ vapor content, which start to condense on the droplets and heats the gas, this is shown by the segment between B and A on the diagram of FIG. 2. We start to compress the working medium by moving the piston 3 inward. The droplets of the fine spray evaporate in the warming gas, thus slowing down the temperature increase. The change of the gas state during compression is shown by the line segment between A and D on the p-V diagram of FIG. 2. During this process the droplets lose water, their concentration increases. After compression the droplets of higher concentration solution must be removed from the working medium, there are several ways to accomplish this, we will return to this subject later. Next, we cool the gas to the state marked by C by injecting dilute solution preferably water into it, this is shown by the segment between D and C on the diagram of FIG. 2, and then varying the state along the line segment between C and B most of the vapor content of the cooling gas mixture is condensed onto the surface of the droplets. In the exhaust stroke the gas and the droplets are removed from the cylinder 1 through the droplet separator 20 and the liquid is returned to the container 10 of the dilute solution. In summary we extract water from the higher concentration solution by investing work, and thus we increase the concentration difference.

Separating the droplets at the end of line segment A-D is very simple with a turbomachinery implementation; the continuously flowing medium should be driven through a droplet separator between the compressor and turbine. In piston engines a possible way is for example that the piston pushes the mixture into a transitory high pressure container through a droplet separator, from which droplet-free gas is loaded into the cylinder at the beginning of the expansion phase.

For the implementation of the working volume we mentioned piston engines and turbomachinery, furthermore in piston based system it could be advisable to use separate cylinders 1 for the intake-compression and the expansion-exhaust strokes, because this way the higher concentration and dilute solutions work in separate cylinders 1 and traces of the solutions which can potentially remain in the cylinder 1 do not worsen the effect of each-other. This way the droplet separation can be realized very simply during the transfer of the working medium from one of the cylinders 1 to the other.

Among the main advantages of the method according to the invention chiefly for mass energy storage and the apparatus implementing the method we can emphasize that compared to existing solutions it is cheap environment friendly, scales well, it has high energy density, it is long lived, it uses simple proven technologies; its energy density is comparable to that of batteries, while it is more durable and cheaper then batteries.

The chief application of the proposed solution is to store the excess energy coming from renewable sources or cheaply producing baseload power plants during periods of low consumption, and to return this energy into the electrical grid during periods of high consumption. Another advantage is that due to its high energy density it can replace larger battery plants.

LIST OF REFERENCE SIGNS

S1-S8 steps
1 cylinder
2 working volume
3 piston
4 piston rod
5 valve
6 valve
7 container
8 duct
9 duct
10 container
11 container
12 tank
13 wall
14 duct
15 injector
16 duct
17 injector
18 pump
19 pump
20 droplet separator
21 droplet separator
22 duct
23 duct
24 container
25 three-port valve
26 three-port valve

The invention claimed is:

1. A method for extracting energy in the form of concentration gradients and for storing energy in the form of concentration gradients, respectively, wherein a process of extracting energy comprising the steps of:

feeding stored gaseous working medium into a working volume, compressing the working medium in the working volume, spraying a dilute solution into the working volume before or during compression, increasing the temperature of the working medium fed in the working volume by compression, evaporating the dilute solution with the working medium of increased temperature, removing heat from the working medium by the evaporating solution, keeping the heat extracted from the working medium in the form of latent heat of the vapor in the working volume, further increasing the temperature of the working medium until the partial pressure of the vapor in it approaches the vapor pressure of a solution of higher concentration at a corresponding temperature, spraying a solution of higher concentration of a vapor pressure of up to 60% of the vapor pressure of the dilute solution into the expanding working medium having a high vapor content, condensing the vapor in the working volume onto solution droplets of the atomized solution and thereby heating the solution droplets, conveying the heat energy of the heated solution droplets to the working medium through contact surfaces of the solution and the working medium, feeding the heat previously conveyed to the dilute solution vapor during the compression back into the working medium plus as much heat as the condensation heat of the warmer vapor to the solution of higher concentration exceeds the heat of evaporation of the dilute solution, using the heat thus fed to perform work by the expansion of the working medium, obtaining the work performed by the working medium, removing the working medium and the solution from the working volume after the gaseous working medium of low relative humidity got into a state close to its initial state, separating the working medium and the solution and returning the working medium to a container for working medium and returning the slightly diluted solution of higher concentration to one of a container for the solution of higher concentrations and an additional container for the solution of intermediate concentration.

2. The method according to claim 1, wherein a process of storing energy further comprises the step of further concentrating the solution of higher concentration by removing water by applying work, thereby increasing the concentration difference, comprising:

spraying a solution of higher concentration into the working medium drawn into the working volume, heating the gas by compression and/or condensation on droplets of the solution of higher concentration, compressing the working medium, slowing the temperature rise in the gas heated by compression by evaporating a solution of higher concentration in contact with the gas over a large area, increasing the concentration of the solution of higher concentration by evaporation, separating the solution thus obtained, which is more concentrated than the initial concentration, from the working medium and returning the solution to the container for solution of higher concentration, cooling the working medium by expansion or by introducing a more dilute solution into the working volume, spraying further dilute solution into the working volume, the majority of the water vapor content of the gas mixture cooling during expansion is condensed onto the surface of the dilute solution, removing the gas and dilute solution from the cylinder, separating the gas and dilute solution and returning the dilute solution to container for dilute solution.

3. The method according to claim 1, comprising using an oxygen-free inert gas as the working medium.

4. The method according to claim 1, comprising using a salt solution as the solution of higher concentration and lower vapor pressure.

5. The method according to claim 4, characterized in that the saline solution is one of a calcium chloride solution of at least 40 mass % or a magnesium chloride solution of at least 30 mass %, or a mixture thereof.

6. The method according to claim 1, comprising heating at least one of the solutions before introducing it into the working volume and cooling the solution heated before being introduced into the working volume to storage temperature after use.

7. The method according to claim 6, comprising, during energy production and before use, adding additional solute material to the solution of higher concentration that has been heated before its introduction into the working volume.

8. The method according to claim 1 comprising increasing the temperature of the container for dilute solution and the container for solution of higher concentration relative to the ambient temperature.

9. The method according to claim 1, comprising injecting a solution of higher concentration at the end of the compression stroke for rapidly heating the working medium.

10. The method according to claim 1, comprising during the compression step injecting a lower amount of dilute solution into the working volume than the maximum which can be evaporated, thus completely evaporating the solution droplets at partial compression, then for rapid heating of the working medium causing an adiabatic change of state by further compression.

11. Apparatus for performing the method for storing energy according to claim 1, comprising:

a container for working medium, a container for dilute solution, a container for solution of higher concentration, a heat engine comprising a working volume for receiving working medium, ducts in communication with the working volume and the container for working medium, ducts in communication with the solution containers in the working volume, wherein a pump (18) is inserted in the duct carrying the dilute solution from the container for dilute solution to the working volume and a pump (19) is inserted in the duct carrying the solution of higher concentration from the container for solution of higher concentration to the working volume, said ducts are connected to the working volume via injection valves, wherein a droplet separator is inserted in the duct providing fluid communication between the working volume and the container for working medium, and a droplet separator is inserted in the duct providing fluid communication between the working volume and the container for working medium, liquid outlets of said droplet separators are connected through respective ducts with the container for dilute solution and the container for solution of higher concentration, respectively, wherein the heat engine is in driving connection with a motor-generator converting electrical energy into mechanical motion and mechanical motion into electrical energy, respectively.

12. The apparatus according to claim 11, characterized in that the container for dilute solution and the container for solution of higher concentration are formed as a single tank comprising a built-in wall separating the more dilute solution and the solution of higher concentration.

13. The apparatus according to claim 12, characterized in that the wall is formed as a flexible wall.

14. The apparatus according to claim 12, characterized in that the wall is movably arranged inside the container.

15. The apparatus according to claim 11, characterized in that it comprises a further container for the diluted solution of higher concentration.

16. The apparatus according to claim 11, characterized in that the container for dilute solution comprises a solution comprising at least 96 mass % of water.

17. The apparatus according to claim 11, characterized in that the container for solution of higher concentration comprises a solution comprising one of calcium chloride of at least 40 mass %, magnesium chloride of at least 30 mass %, or a mixture thereof.

18. The apparatus according to claim 11, characterized in that the solution of higher concentration stored in the container for solution of higher concentration is a saturated solution at storage temperature comprising solute material in undissolved state.

19. The apparatus according to claim 11, characterized in that at least one of the container for working medium, the container for dilute solution, the container for solution of higher concentration and the working volume is made of thermal insulation material.

20. The apparatus according to claim 11, characterized in that at least one of the container for working medium, the container for dilute solution, the container for solution of higher concentration and the working volume is provided with external thermal insulation.

21. The apparatus according to claim 11, characterized in that the heat engine comprising the working volume for receiving the working medium comprises a motor including a cylinder receiving a movably guided piston.

22. The apparatus according to claim 11, characterized in that the heat engine comprising the working volume for receiving the working medium comprises a rotary turbine-compressor motor.

23. The apparatus according to claim 11, characterized in that the working volume is in fluid communication with the container for working medium via valves.

* * * * *